US009320303B2

(12) United States Patent
Howard et al.

(10) Patent No.: US 9,320,303 B2
(45) Date of Patent: Apr. 26, 2016

(54) INFANT SLEEP SUIT

(71) Applicants: Maureen A. Howard, Downingtown, PA (US); Robert C. Howard, Downingtown, PA (US)

(72) Inventors: Maureen A. Howard, Downingtown, PA (US); Robert C. Howard, Downingtown, PA (US)

(73) Assignee: BABY MERLIN COMPANY, Downingtown, PA (US)

( * ) Notice: Subject to any disclaimer, the term of this patent is extended or adjusted under 35 U.S.C. 154(b) by 0 days.

(21) Appl. No.: 14/606,575

(22) Filed: Jan. 27, 2015

(65) Prior Publication Data

US 2015/0143603 A1 May 28, 2015

Related U.S. Application Data

(63) Continuation of application No. 11/209,266, filed on Aug. 23, 2005, and a continuation of application No. 14/332,985, filed on Jul. 16, 2014, now Pat. No. 8,943,615.

(51) Int. Cl.

| | |
|---|---|
| ***A41B 13/00*** | (2006.01) |
| ***A41B 13/08*** | (2006.01) |
| ***A41D 10/00*** | (2006.01) |
| ***A41D 11/00*** | (2006.01) |
| *A41B 13/06* | (2006.01) |

(52) U.S. Cl.

CPC ..... *A41B 13/08* (2013.01); *A41B 13/005* (2013.01); *A41D 10/00* (2013.01); *A41D 11/00* (2013.01); *A41B 13/065* (2013.01)

(58) Field of Classification Search

CPC ..... A41B 13/06; A41B 13/005; A41B 13/08; A41D 10/00; A41D 11/00

See application file for complete search history.

(56) References Cited

U.S. PATENT DOCUMENTS

| | | | | | |
|---|---|---|---|---|---|
| 1,973,421 | A * | 9/1934 | Wallace | A41B 13/005 | 2/79 |
| 2,101,701 | A * | 12/1937 | Cohen | A41D 10/00 | 2/83 |
| 2,374,299 | A * | 4/1945 | O'Hara | A41B 13/06 | 2/114 |
| 2,465,622 | A * | 3/1949 | Widetsky | A41B 13/06 | 128/873 |
| 2,469,556 | A * | 5/1949 | Jacobson | A41B 13/005 | 2/69.5 |
| 2,505,239 | A * | 4/1950 | Goldstein | A41B 13/005 | 2/80 |
| 2,538,420 | A * | 1/1951 | Junghans | A41B 13/06 | 2/69 |
| 2,578,323 | A * | 12/1951 | Sillaway | A41B 13/06 | 2/69.5 |
| 2,621,336 | A * | 12/1952 | Wendroff | A41B 13/005 | 2/227 |
| 2,670,471 | A * | 3/1954 | Kaufman | A41B 13/005 | 2/269 |
| 2,738,512 | A * | 3/1956 | Winer | A41B 13/005 | 2/69.5 |
| 2,769,177 | A * | 11/1956 | Berg | A41B 13/005 | 2/80 |
| 3,028,857 | A * | 4/1962 | Parker | A61H 36/00 | 601/136 |
| 3,135,961 | A * | 6/1964 | Roderick | A41D 13/015 | 2/267 |

(Continued)

*Primary Examiner* — Richale Quinn

(74) *Attorney, Agent, or Firm* — Robert R. Axenfeld

(57) ABSTRACT

An innovative sleeping suit for infants, configured to provide warmth, a contained environment, and positive proprioceptive input, and thereby reduce neurological reflexive twitching or habitual waking patterns prevalent when infants are placed on their backs for sleeping and are not swaddled. The weighting in the suit is believed to reduce the neurological reflexive twitching and provides a swaddling effect to infants helping them to fall asleep and remain sleeping when on their backs. At least a portion of an anterior portion of the suit includes the weighting. The weighting may be accomplished by varying the thickness of the materials and/or quantity of layers of materials used on the anterior portion of the suit. The weighting may be distributed uniformly throughout the suit, the anterior portion of the suit, or can be strategically placed at proprioceptive target points along the anterior portion of the suit.

3 Claims, 4 Drawing Sheets

(56) References Cited

U.S. PATENT DOCUMENTS 3,555,567 A * 1/1971 Owen ..... A41B 13/005 2/69.5
4,451,932 A * 6/1984 Wagemann ..... A61F 5/3784 128/874
4,539,700 A * 9/1985 Sato ..... H04R 5/023 224/230
4,569,874 A * 2/1986 Kuznetz ..... A41D 31/0038 2/272
4,726,076 A * 2/1988 Douez ..... A41D 13/1272 2/69
4,884,303 A * 12/1989 Scherer ..... A47G 9/086 2/69.5
4,897,885 A * 2/1990 Lunt ..... A41B 13/06 2/69.5
4,998,296 A * 3/1991 Stames ..... A41D 13/02 2/458
5,023,952 A * 6/1991 Palmer ..... A41B 13/005 2/69
5,052,052 A * 10/1991 Gilford ..... A41D 13/015 2/16
5,058,208 A * 10/1991 Adams ..... A41B 13/05 2/227
5,129,406 A * 7/1992 Magnusen ..... A61F 5/37 128/845
5,131,096 A * 7/1992 Olson ..... A41D 15/00 2/69
5,148,002 A * 9/1992 Kuo ..... H01Q 1/273 219/211
5,511,245 A * 4/1996 Hayes ..... A41D 13/00 2/272
5,563,951 A * 10/1996 Wang ..... G02C 11/06 381/301
5,640,717 A * 6/1997 Ray ..... A41B 13/06 2/69
5,722,094 A * 3/1998 Ruefer ..... A41B 13/06 2/69
5,918,313 A * 7/1999 Trujillo ..... A41D 13/0015 2/227
5,973,602 A * 10/1999 Cole, III ..... A62B 17/003 2/93
6,045,575 A * 4/2000 Rosen ..... A61N 5/0621 2/905
6,266,822 B1 * 7/2001 Joyce ..... A41B 13/06 2/69
6,289,524 B1 * 9/2001 Wright ..... A41D 13/015 2/455
6,339,847 B1 * 1/2002 Hanks ..... A41B 13/005 2/269
6,393,612 B1 * 5/2002 Thach ..... A41B 13/065 2/69.5
6,708,342 B2 * 3/2004 Boersema ..... A41B 11/008 2/69
6,868,566 B2 * 3/2005 Gatten ..... A41B 13/06 2/69
6,895,261 B1 * 5/2005 Palamides ..... H04B 1/385 455/100
6,978,479 B2 * 12/2005 Thach ..... A41B 13/065 2/111
7,246,392 B2 * 7/2007 Schmid ..... A41B 13/06 2/69.5
8,943,615 B2 * 2/2015 Howard ..... A41B 13/005 2/111
2001/0054192 A1 * 12/2001 Haar ..... A42B 3/0406 2/69
2003/0019015 A1 * 1/2003 Hugh ..... H04R 1/1016 2/265
2005/0120459 A1 * 6/2005 McConnell ..... G01K 13/002 2/69.5
2005/0125895 A1 * 6/2005 Gatten ..... A41B 13/06 5/482
2005/0223476 A1 * 10/2005 Volk ..... A41D 13/005 2/458
2006/0075537 A1 * 4/2006 Tsai ..... A41D 1/005 2/69
2006/0182297 A1 * 8/2006 Cyr ..... A41D 1/005 381/333
2006/0185055 A1 * 8/2006 DeWitt ..... A41B 13/08 2/111
2006/0218692 A1 * 10/2006 Lamarque ..... A41D 13/1245 2/114
2008/0120774 A1 * 5/2008 Hite ..... A41B 13/06 5/494

* cited by examiner

INFANT SLEEP SUIT

CROSS-REFERENCE TO RELATED APPLICATIONS

This application is a continuation of application Ser. No. 11/209,266 ('266 Application) filed on Aug. 23, 2005, and a continuation of application Ser. No. 14/332,985 filed on Jul. 16, 2014, which is a continuation of the '266 Application. The '266 Application claims the benefit of U.S. Provisional Application Ser. No. 60/613,983 filed on Sep. 28, 2004.

TECHNICAL FIELD

This invention relates generally to sleepwear for infants.

BACKGROUND

Medical studies have shown that infants who sleep on their backs have a reduced risk of dying suddenly from Sudden Infant Death Syndrome (SIDS), compared to infants who sleep on their stomachs. Dissemination of this information by the American Academy of Pediatrics to pediatricians and parents has resulted in an increase in the practice of placing infants in a supine position, i.e., on their backs for sleeping. A decrease in the incidence of SIDS has been observed in recent years, which is thought to be causally related to placing infants to sleep on their backs.

Unfortunately, many infants have difficulty sleeping soundly on their backs. The direct cause of this is unknown. However, swaddling (the practice of wrapping infants tightly in a blanket) has been known to help infants sleep on their back as it provides warmth, security and proprioceptive input similar to that found in the womb. Swaddling soothes the infant and likely reduces spontaneous arousals from sleep while in the supine position. Swaddling an infant is easier the first several weeks, or months, but problems arise as an infant reaches the age of approximately two-to-three months of age. At this transitional stage, infants begin to wiggle and kick and can ultimately free themselves from the swaddle. Once the infant escapes the confines of a swaddled blanket, or becomes too big for swaddling, sleep disturbances often reoccur because infants at this age are still prone to reflexive-type twitches or habitual waking patterns that prevent sustained sleep.

Sleep disturbance can occur when an infant is not swaddled because the nervous system is still immature, causing neurological reflexive-type twitches, such as a jerking motion in the arms or legs, and/or habitual waking patterns, which often startle and wake the infant prematurely. Additionally, infants around this age have difficulty falling and staying asleep without some sort of parental intervention such as rocking, or nursing. Consequently, infants and their caregivers are often not well rested.

Other sleep products such as swings and bouncing seats are good at initially lulling infants to sleep, but often are outgrown by infants as they reach 15 to 20 pounds, and are also unsafe for longer periods of sleep. Moreover, these types of products do not teach good sleeping habits.

Current sleep wear found in the retail market, such as sleeping gowns, sacks and footed-pajamas, are designed to replace blankets and keep infants warm, but do nothing to provide the secure and snug feeling of swaddling that helps infants fall asleep and remain sleeping for longer periods, or enable a child to fall back asleep if woken prematurely.

SUMMARY

Described herein is an innovative sleeping suit for infants, configured to provide warmth, security of a contained environment and positive proprioceptive input, and thereby reduce neurological reflexive twitching or habitual waking patterns prevalent when infants are placed on their backs for sleeping and are not swaddled. The weighting in the suit helps reduce neurological twitches and provides a swaddling effect to infants helping them to fall asleep and remain sleeping when on their backs. Additionally, the suit eliminates the need for blankets.

In one exemplary implementation, at least a portion of an anterior portion of the suit (frontal portion) includes weighting to provide the proprioceptive input to an infant when the infant is sleeping in the supine position. The weighting may be accomplished by varying the thickness of the materials and/or quantity of layers of materials used on the anterior portion of the suit. The weighting materials may include a standard polyfill fiber, other polyester blends, cotton blends, cotton quilting, flannel, silk, combinations of the aforementioned, or any other suitable material(s).

Additionally, weighting may be accomplished by adding specific weighted items to the suit. For example, weighted items may be added to self-contained chambers located within the inner layers of the suit or attached to the outermost layer portion. The weighted items may include beans (such as a beans found in bean bags), seeds, sand, hypoallergenic plastic granule packets, or any variety of other suitable items.

The weighting can be distributed uniformly throughout the entire suit, distributed on the anterior portion of the suit, or can be strategically placed at proprioceptive target points on the anterior portion of the suit. These proprioceptive target points include the primary joint areas such as the shoulder girdle, and hip area. However, as mentioned before, weighting could be distributed uniformly throughout the entire suit, the anterior portion, or could be distributed in less than all of the proprioceptive target points described above. For example, a sleep suit could contain weighting targeted to the shoulder girdle area only.

Unlike sleepwear on the market designed primarily to replace blankets and keep active babies warm, the innovative suit described herein not only keeps babies warm and eliminates the need for blankets, but also provides the swaddling effect and security that comforts them to sleep on their own and/or to fall back to sleep if woken. Consequently, the suit eliminates the risks related to blankets, such as covering the infant's airways. Moreover, the weight and bulk of the suit helps prevent the infant from turning over onto their stomach while sleeping. Thus, an ultimate goal of the suit is to improve the quality and duration of the infant's sleep, making for happier children and more well-rested caregivers.

As the baby gets a little older, the physiologic needs provided by the suit may lessen, but by that point the association between sleep and the suit has been well established. Subsequently, the suit becomes a comfort and security item for the baby. This is helpful when the baby sleeps in different environments that he may not be accustomed (i.e., a relative's house, a hotel/motel, a babysitter's house, daycare, and so forth).

The suit also assists in the transition of an infant from more confined spaces of sleeping, such as a bassinette, to larger and more spacious cribs, a milestone that can disrupt sleep patterns. The sleep suit acts as a transition object because it continues to provide the sense of security derived from swaddling or sleeping in a constrained space, as infants adjust to sleeping in a more open environment.

The suit is designed to be used for back sleeping, the preferred position for sleep to reduce the risk of SIDS. The suit typically eliminates a need for blankets and other loose bedding, which is consistent with recommendations to prevent SIDS. The suit may be worn over varying types of undergarments (ranging from a diaper, to lightweight cotton clothing or heavier sleepwear) depending on the environment and the infant's heat tolerance. It is noted that parents and caregivers should monitor their children while sleeping to make sure they are comfortable and not overheated. For example, it is recommended that the suit first be used during naps so parents can monitor their baby's body temperature, since each baby may regulate their body temperatures differently.

The suit may be designed in various suitable sizes, such as small and large. For example, the small size may fit infants between three and six months, or roughly 10 pounds to 18 pounds. The large size may fit infants aged six months to nine months, or roughly 18 pounds to 22 pounds. Other sizes are possible, including smaller sizes, larger sizes, or sizes in between.

In certain implementations, the suit may have a scooped neckline having various configurations (such as circular, oval, squared, etc.) that prevents the suit from obstructing the face and neck of an infant. The suit may cover the entire body from the neckline down; including the torso, the front, the back, arms and legs, while leaving the head exposed. The suit may have openings for hands and feet. Alternatively, in other implementations, the hands and/or feet may be enclosed with fabric covers to provide extra warmth. Fabric covers may be fastened by snaps, buttons or Velcro or other fastening mechanisms and may be removed completely when not needed.

The suit may contain a ventilation flap on the front of the suit. The ventilation flap is formed when the suit is unfastened along the front of the suit. The unfastened portion is folded back onto itself and secured in place by snaps attached to one of the layers of the suit. By folding the flap back onto itself, a portion of the infant's chest is exposed and therefore allows heat to escape the suit so that an infant does not overheat. In addition to a snap, a button or Velcro could be used to secure the ventilation flap. Ventilation flaps, such as made of a mesh material, could be placed along the front sides of the suit, which may be suitable for warmer climates.

Further details and advantages of the infant sleep suit will become apparent with reference to the accompanying drawings and the following detailed description.

BRIEF DESCRIPTION OF THE DRAWINGS

The detailed description is described with reference to the accompanying figures. In the figures, the left-most digit(s) of a reference number identifies the figure in which the reference number first appears.

DETAILED DESCRIPTION

Exemplary Sleep Suit

Figure 1:
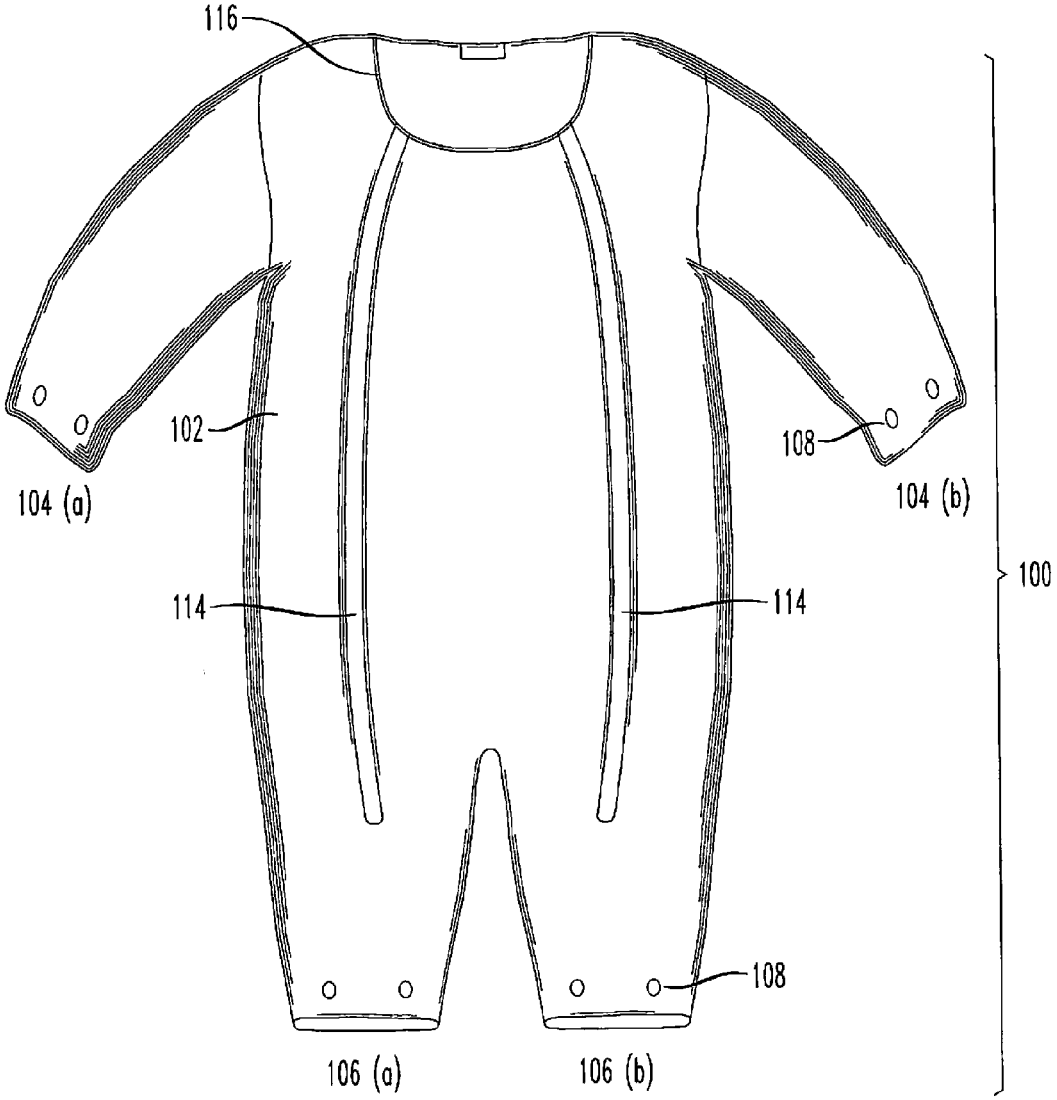
FIG. 1 shows a frontal view of a sleep suit.

FIG. 1 shows an innovative sleep suit 100 for infants configured to provide warmth, security and positive proprioceptive input to an infant, and thereby reduce neurological reflexive twitching or habitual waking patterns when the infant is placed on his back for sleeping and is not swaddled.

Suit 100 is also configured to cover an infant's, front, back, arms and legs, while leaving the head exposed. Openings 104*a* & 104*b* for the hands and openings 106*a* & 106*b* for the feet, expose the hands and feet, respectively, for ventilation (heat dissipation), free movement, grasping objects, and play. The hands and/or feet may be covered with material integrated as part of suit 100 or the coverings (not shown) may be secured to suit 100 by attachment elements 108, such as snaps, buttons, Velcro, or a combination of the aforementioned.

A fastening mechanism 114 extends from neckline 116 to a leg area of an anterior portion 102 of suit 100. In one implementation, fastening mechanism 114 is a double plastic non-metal zipper. The zipper may be covered by zipper cover (not shown). However, suit 100 may include alternative fastening mechanisms, such as, but not necessarily limited to, a single zipper, Velcro, buttons, snaps, tabs, ties, or any combination thereof. Fastening mechanism 114 may also be positioned in other areas of suit 100, along the side of suit 100 and may extend the full length of suit 100.

Exemplary Weighting

Suit 100 includes weighting to provide the proprioceptive input to an infant when the infant is sleeping in the supine position. Proprioceptive input is a type of pressure input applied to the joints of an infant by the weighting of suit 100. The proprioceptive input tends to calm an infant, whose sensory integration regulators and nervous system are not yet mature.

The weighting may be accomplished by varying the thickness of the materials and/or quantity of layers of materials used on anterior portion 102 of the suit 100. The weighting materials may include a standard polyfill fiber, other polyester blends, cotton blends, cotton quilting, flannel, silk, combinations of the aforementioned, or any other suitable material(s). Additionally, weighting may be accomplished by adding specific weighted items to the suit. For example, weighted items may be added to self-contained chambers located within the inner layers of the suit or attached to the outermost layer portion. The weighted items may include synthetic materials such as hypoallergenic plastic granule packets, beans (such as a beans found in bean bags), seeds, sand, or any variety of other suitable items.

The weighting can be distributed uniformly throughout the entire suit, distributed on the anterior portion of the suit, or can be strategically placed on the anterior portion of the suit corresponding to proprioceptive target points of a baby. Proprioceptive target points include torso joint areas such as the shoulder girdle, and hip area of a baby. However, as mentioned before, weighting could be distributed uniformly throughout the entire suit, the anterior portion, or could be distributed in less than all of the corresponding proprioceptive target points described above. For example, a sleep suit could contain weighting corresponding to the shoulder girdle area only.

Thus, suit 100 is configured to provide a swaddling effect and positive proprioceptive input to infants by increasing weighting of materials used throughout sleep suit 100. Several exemplary ways of achieving the weighting on suit 100 shall now be described in more detail.

Figure 2:
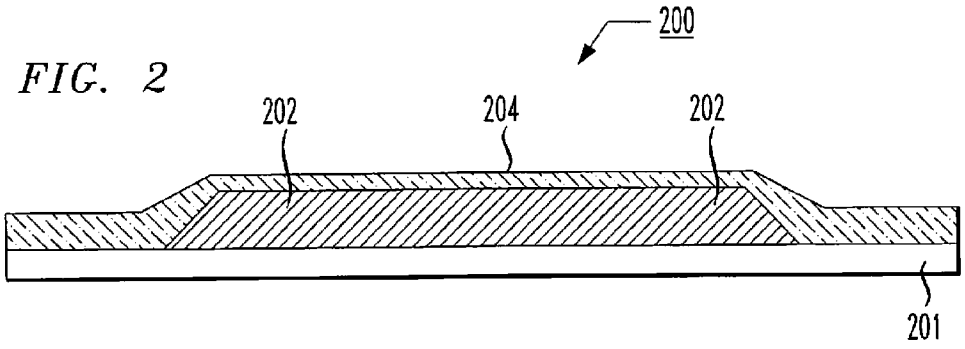
FIG. 2 is a cross-sectional view of the anterior portion of the sleep suit and shows the first layer of material, the second layer of material and the weighted material of the sleep suit.

FIG. 2 represents a cross-sectional view 200 of an anterior portion 102 of sleep suit 100 in which weighting is achieved by using multiple layers of material. Anterior portion 102 includes a first layer of material 201, a second layer of material 202, and a third layer of material 204. In this example, first layer of material 201 is the inner most layer of material closest to an infant's body. First layer of material 201 is typically a soft and comfortable material suitable for contact with an infant's skin, such as 100% cotton, cotton blends, silk and/or hypoallergenic fabrics.

Second layer of material 202 is sandwiched between first layer of material 201 and third layer of material 204. Second layer of material 202 (also referred to as the weighted material) may be a standard polyfill fiber, other polyester blends, cotton blends, cotton quilting, flannel, silk, or combinations of the aforementioned. Note that the drawings are not to scale and that the thickness of second layer of material 202 may vary depending on the fibers used. Alternatively, weighting may be achieved by including multiple layers of various materials in between first layer of material 201 and third layer of material 204. Additionally, any combination of materials that provide a weighting to anterior portion 102 of suit 100 and positive proprioceptive feedback to the infant may be used.

Third layer of material 204 is an environmental layer that adds durability and warmth to suit 100. For instance, third layer of material 204 could be treated to repel stains. In warmer environments, third layer of material 204 may include fine percale cotton. If more warmth is needed, such as in colder environments, micro-fleece may be included for third layer of material 204. In either case, third layer of material 204, could be made from other materials, such as cotton-blends, nylon, polyester, flannel, jersey knit, silk and other fabrics.

Figure 3:
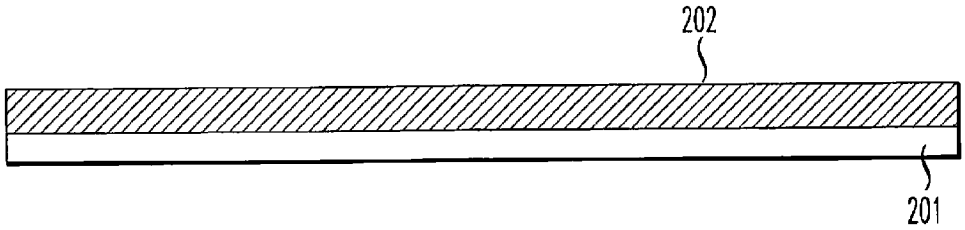
FIG. 3 is a cross-sectional view of the anterior portion of the sleep suit and shows the first layer of material and a uniform distribution of the weighted material in place of a second layer.

In the event that a third layer of material 204 is not used for sleep suit 100, a weighting can be achieved by attaching second layer of material 202 to first layer of material 201—as shown in FIG. 3. Again, second layer of material 202 need not be a single layer of material, but could be a combinational set of layers and various materials.

Figure 4:
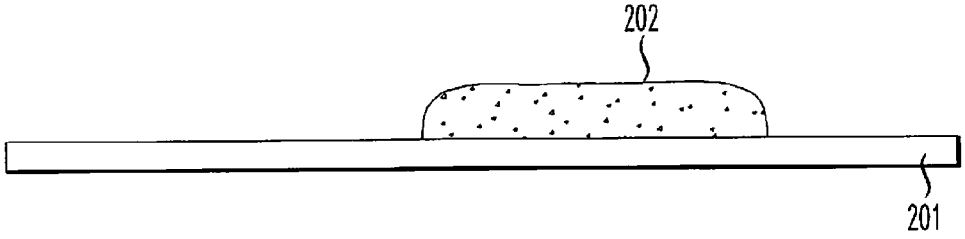
FIG. 4 shows a cross-sectional view of the anterior portion of the suit and shows the weighted material attached to the first layer of material in a patch-like fashion.

FIG. 4 represents yet another alternative to achieve weighting along anterior portion 102 of suit 100. In this embodiment, second layer of material 202 is attached to first layer of material 201 in a patch-like weighting pattern.

As mentioned above, the weighting of the sleep suit may be distributed evenly along the anterior portion of the sleep suit. Alternatively, the weighting may be distributed at specific areas along the anterior portion which correspond to major joint areas of the infant's torso, such as the shoulder girdle, and hip area.

Figure 5:
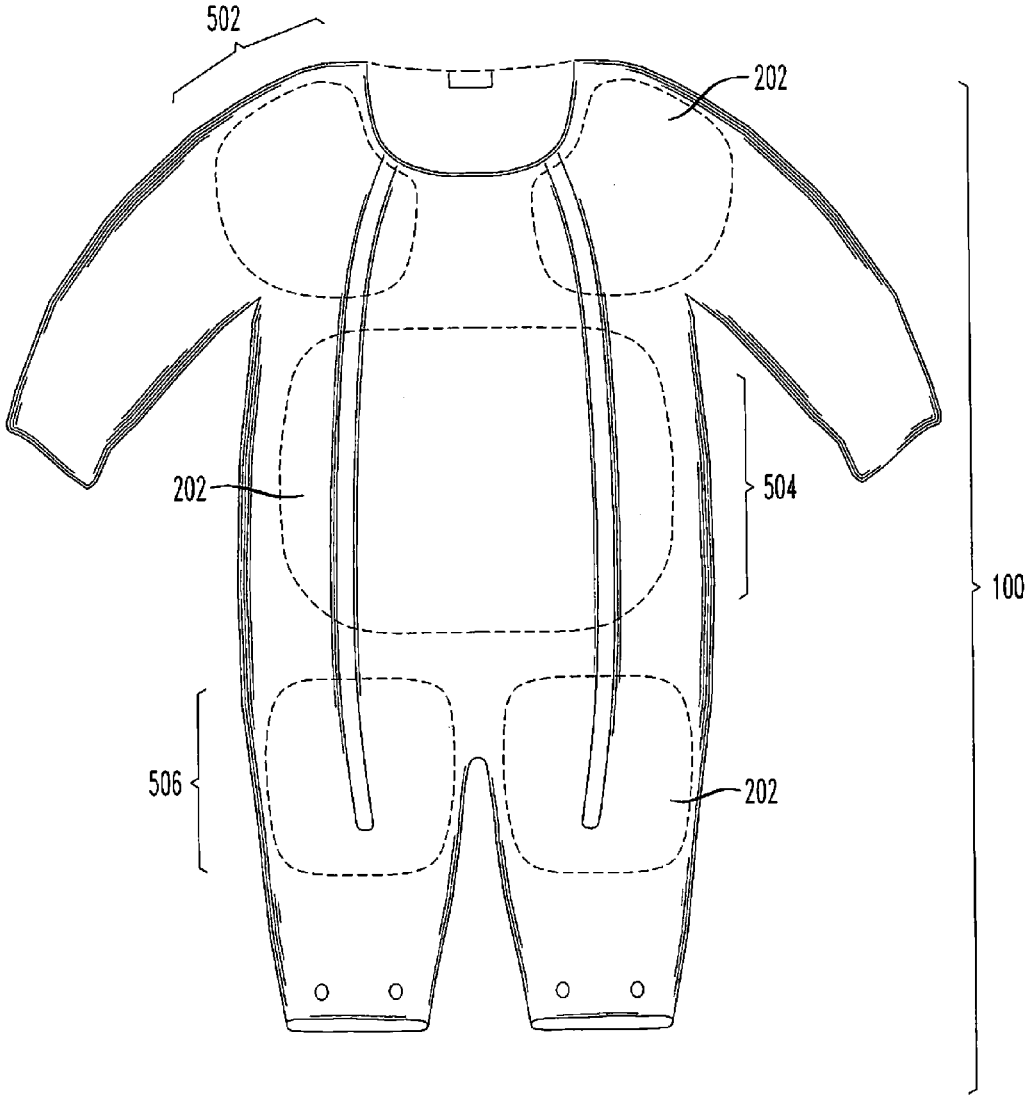
FIG. 5 shows a representative distribution of the weighted material within the anterior portion of the sleep suit to correspond to proprioceptive targets.

FIG. 5 shows a representative distribution of weighting with second layer of material 202 within the anterior portion 102 of the suit 100. In one implementation the suit distributes weighting in the shoulder girdle area 502, chest area 504 and hip area 506. The placement of second layer 202 at the shoulder 502, chest 504, and hips 506 targets sensory points most receptive to proprioceptive input. However, distribution of second layer 202 can vary within the anterior portion 102 of the suit 100 and can target individual sensory points or a combination of sensory points along an infant's body.

It is noted that suit 100 may include Velcro patches or other fastening devices on which weighting may be attached to the exterior of suit 100. The weighting may also be applied in the form of patches that may be ironed on to suit 100. Weighting may also include self-contained bags, such as bean-bags, that can be attached to suit 100.

Exemplary Suit Accessories

Figure 6:
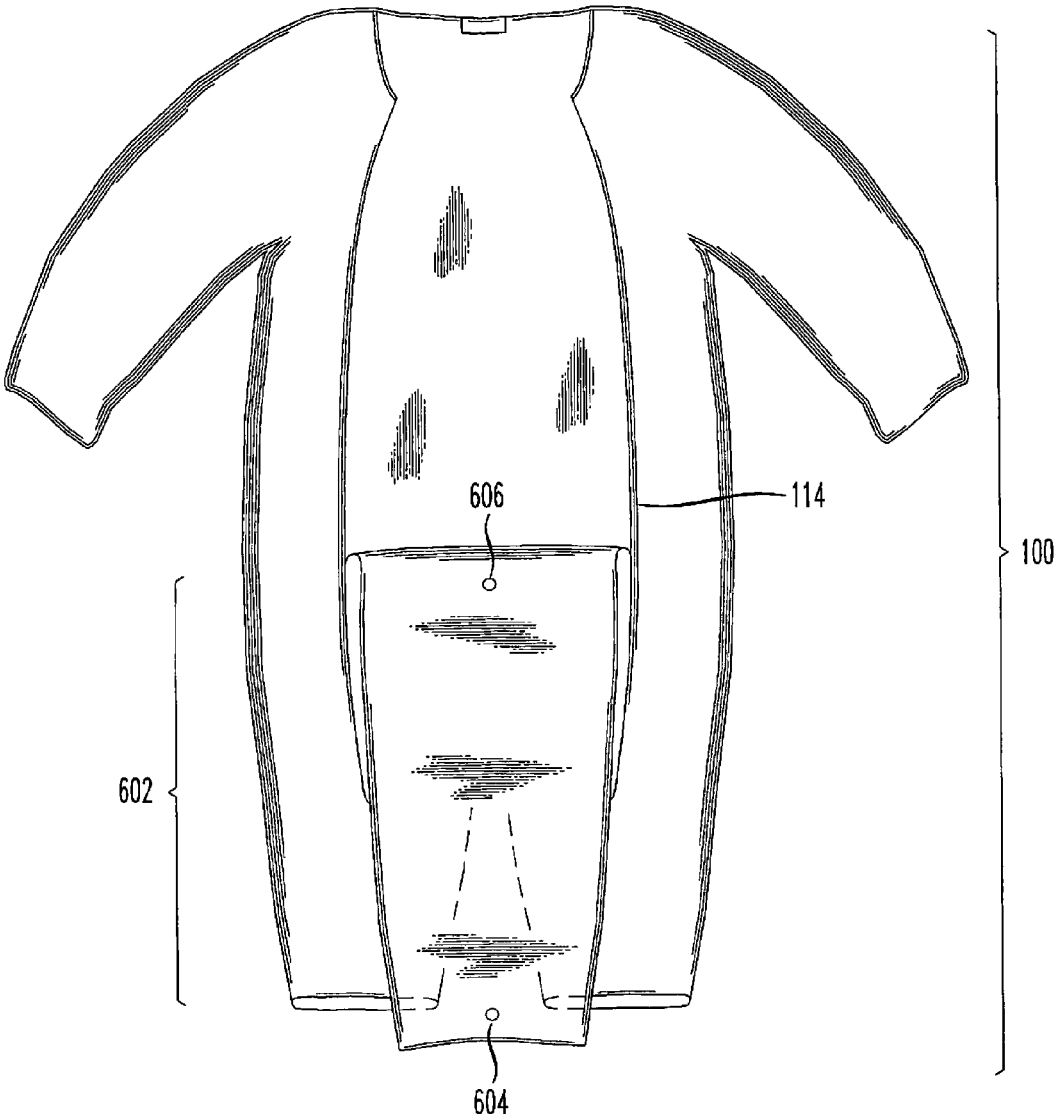
FIG. 6 shows a sleep suit unfastened to show the formation of a fabric panel that can be folded back and secured to create a ventilation flap.

Turning now to FIG. 6, the suit 100 may include suitable fastening mechanisms 114 along the anterior side of the sleep suit 100. The suit 100 may include a double non-metal zipper that can be unfastened to create a ventilation flap 602 along the front of the suit 100. A special ventilation feature can allow for extra aeration, such as in warmer environments or to prevent overheating. For example, the parent or caregiver could unfasten the front of the suit, thereby creating a panel of material that becomes the ventilation flap 602. The ventilation flap 602 is folded back upon itself and is secured in place by two snaps; a first snap 604 is located at the top of the ventilation flap 602 and is secured to a second snap 606 located at the base of the ventilation flap 602. The snaps may be located inside or outside of suit 100. It should be readily appreciated that as an alternative to snaps, other fastening mechanisms could be used to secure the ventilation flap 602, such as a button, Velcro, or other suitable attachment systems.

In the alternative, ventilation could be provided by mesh inserts, or other suitable venting mechanisms, under the arms or along the sides of the suit 100, which may be suitable for warmer environments (not shown in illustrations).

Rolls (not shown) could also be secured to the sides of suit 100 to prevent an infant from flipping on his stomach. The rolls may be integrated as part of suit 100 or may be attached thereto by a fastening means, such as Velcro, a zipper, and so forth.

Although the present invention has been described in detail, those skilled in the art should understand that they can make various changes, substitutions and alterations herein without departing from the spirit and scope of the invention in its broadest form. Additionally, the embodiments described above are to be considered in all aspects as illustrative only and not restrictive in any manner. Thus, other exemplifying embodiments, and implementations that can support various aspects of the invention may be utilized without departing from the essential characteristics described herein. These and various other adaptations and combinations of features of the embodiments disclosed are within the scope of the invention. The invention is defined by the claims and their full scope of equivalents.

What is claimed is:

1. Sleapwear for an infant beyond the age of swaddling, the sleepwear comprising:

a suit having an anterior portion and posterior portion configured to fit over the front and back, respectively, of the infant's body, the suit includes sleeves and leggings, wherein the sleeves and leggings have no coverings for hands and feet of the infant, respectively, to expose the hands and feet for purposes of ventilation and heat dissipation;

wherein the anterior portion of the suit further includes at least first, second, and third layers of material, wherein the first layer of material is an inner most layer of material closest to an infant's body, the third layer of material is an environmental layer, and the second layer of material is located between the first layer of material and the third layer of material on the anterior portion of the suit and at least corresponding to the shoulder area of the infant; and wherein the second layer comprises a layer of material that is of greater thickness than the first layer of material or the third layer of material, and is configured to provide weighted pressure to at least one proprioceptive target point of an infant's body to reduce neurological reflective twitching or habitual waking patterns of an infant, thereby improving the quality and duration of sleep of the infant when sleeping in a supine position, wherein the posterior portion of the suit does not include the second layer of material and has less thickness and weight than the anterior portion of the suit.

2. The sleepwear of claim 1, wherein the second layer of material is comprised of at least one of a synthetic material, beans, seeds, and sand.

3. The sleepwear of claim 1, wherein the second layer of material is distributed in at least one of the following ways: uniformly along the anterior portion of the suit, and only at specific locations along the anterior portion of the suit corresponding to proprioceptive target point of an infant's body.

* * * * *